US005666712A

United States Patent [19]

Cvetkov

[11] Patent Number: 5,666,712

[45] Date of Patent: Sep. 16, 1997

[54] METHOD OF MAKING DESIGNS USING MAGNETIC MATERIALS

[75] Inventor: Nikolai E. Cvetkov, Beaverton, Oreg.

[73] Assignee: Advanced Design & Research Corp., Beaverton, Oreg.

[21] Appl. No.: 502,373

[22] Filed: Jul. 14, 1995

[51] Int. Cl.[6] ..... B23P 25/00

[52] U.S. Cl. ..... 29/458; 446/139; 434/73; 434/134; 434/168; 40/711

[58] Field of Search ..... 434/168, 128, 434/190, 428, 73, 134; 273/239; 446/129, 132, 137, 139; 40/711, 449, 600, 621; 29/458

[56] References Cited

U.S. PATENT DOCUMENTS

| | | | |
|---|---|---|---|
| 3,608,906 | 9/1971 | Odier | 273/157 R |
| 3,660,926 | 5/1972 | Lerner et al. | 446/139 |
| 3,836,395 | 9/1974 | Roller et al. | 117/238 |
| 4,046,932 | 9/1977 | Hartmann et al. | 428/64 |
| 4,100,326 | 7/1978 | Somezawa et al. | 427/130 |
| 4,332,840 | 6/1982 | Tanaka et al. | 427/130 |
| 4,358,388 | 11/1982 | Daniel et al. | 252/62.54 |
| 4,454,174 | 6/1984 | Nakayama et al. | 252/62.54 |
| 4,454,202 | 6/1984 | Komine et al. | 428/423.1 |
| 4,632,866 | 12/1986 | Kubota et al. | 428/328 |
| 4,761,243 | 8/1988 | Kakuishi et al. | 252/62.54 |
| 4,785,562 | 11/1988 | Good | 40/711 |
| 4,806,102 | 2/1989 | Pedersen et al. | 434/73 |
| 4,846,689 | 7/1989 | Day | 434/168 |
| 4,952,153 | 8/1990 | McAllister | 434/168 |
| 5,178,573 | 1/1993 | Smith | 446/139 |
| 5,203,847 | 4/1993 | Butt | 434/73 |
| 5,303,489 | 4/1994 | Blegen | 40/711 |
| 5,320,769 | 6/1994 | Kinoshita et al. | 252/62.54 |
| 5,375,351 | 12/1994 | King et al. | 40/711 |

FOREIGN PATENT DOCUMENTS

| | | | |
|---|---|---|---|
| 332252 | 10/1919 | Germany | 446/129 |
| 2554348 | 6/1977 | Germany | 434/73 |

*Primary Examiner*—David P. Bryant

*Attorney, Agent, or Firm*—Klarquist Sparkman Campbell Leigh & Whinston, LLP

[57] ABSTRACT

Two-dimensional designs are created by providing a magnetic surface and attaching magnetic parts to the surface. The parts may be precut geometric and representational forms cut from flexible magnetic material. The surface may be a surface painted with a magnetic paint. Three-dimensional designs are created by providing a metallic surface and attaching parts to the surface using small permanent magnets. A magnetic paint formulation and formulations for moldable clay-like and dough-like magnetic compositions are disclosed.

7 Claims, 4 Drawing Sheets

METHOD OF MAKING DESIGNS USING MAGNETIC MATERIALS

FIELD OF THE INVENTION

This invention relates to magnets, magnetizable materials and magnetic paints and, more particularly, to methods of using them in the making of two- and three-dimensional designs.

BACKGROUND OF THE INVENTION

Magnets, magnetizable materials and magnetic paints are all well-known items useful in many fields. To my knowledge, however, none of them has been used in the making of two- and three-dimensional designs that can be used in schools, both pre-schools and schools for older children, art classes, window decorations, other public displays of a temporary nature, in the theater, as games at social parties, and otherwise where expressions of individuality are to be encouraged. Magnetic paints of various types have been used in magnetic recording media, including magnetic tapes and disks. Examples include the inventions of U.S. Pat. Nos. 3,836,395, 4,046,932, 4,100,326, 4,332,840, 4,358,388, 4,454,202, 4,594,174, 4,632,866, 4,761,243, and 5,320,769. None of these, however, envisions use of magnetic materials in the making of designs for the purposes above set forth.

Accordingly, it is a principal object of the present invention to provide methods of making two- and three-dimensional designs using magnetic materials, including magnets, magnetizable materials, and magnetic paints.

It is a further object of the present invention to provide such methods wherein the magnetic materials above set forth can be used to make temporary designs for broad applications in education, displays, for social gatherings, and otherwise.

SUMMARY OF THE INVENTION

My method of using magnetic materials in the making of two- and three-dimensional designs includes providing a magnetic surface, selecting a plurality of magnetic parts from the group consisting of substantially two-dimensional precut geometric forms, substantially two-dimensional precut representational forms, and three-dimensional representational forms, and attaching the parts to the surface to create an individually expressive desired design.

The magnetic surface may comprise a magnetizable sheet material, such as a metallic sheet, and a surface painted with a magnetic paint. The magnetic parts may comprise parts made of flexible magnetic material.

My invention further includes a method of attaching a substantially two-dimensional item to a wall such that the item can be removed from the wall without any possibility of damaging or marring the same. My method includes first painting the surface of the wall with a magnetic paint. I then provide a substantially two-dimensional frame of flexible magnetic material having interior dimensions less than the exterior dimensions of the item to be attached to the wall. I then attach the item to the wall by placing the frame over the item and adhering the frame to the wall, whereby the item is removably attached to the wall without any possibility of damaging or marring the same.

My method of using magnetic materials in the making of three-dimensional designs includes providing a magnetic surface, and attaching to the surface a plurality of two-dimensional metallic geometric forms and a plurality of magnets of a size substantially smaller than the two-dimensional forms, the magnets serving to attach the forms to the magnetic surface and to each other, thereby to create an individually expressive desired three-dimensional design.

The invention further contemplates use of hardenable and malleable, moldable magnetic compositions that can be molded into desired three-dimensional forms to which magnets, and items attached to magnets, may be temporarily adhered.

DESCRIPTION OF THE PREFERRED EMBODIMENTS

Figure 1:
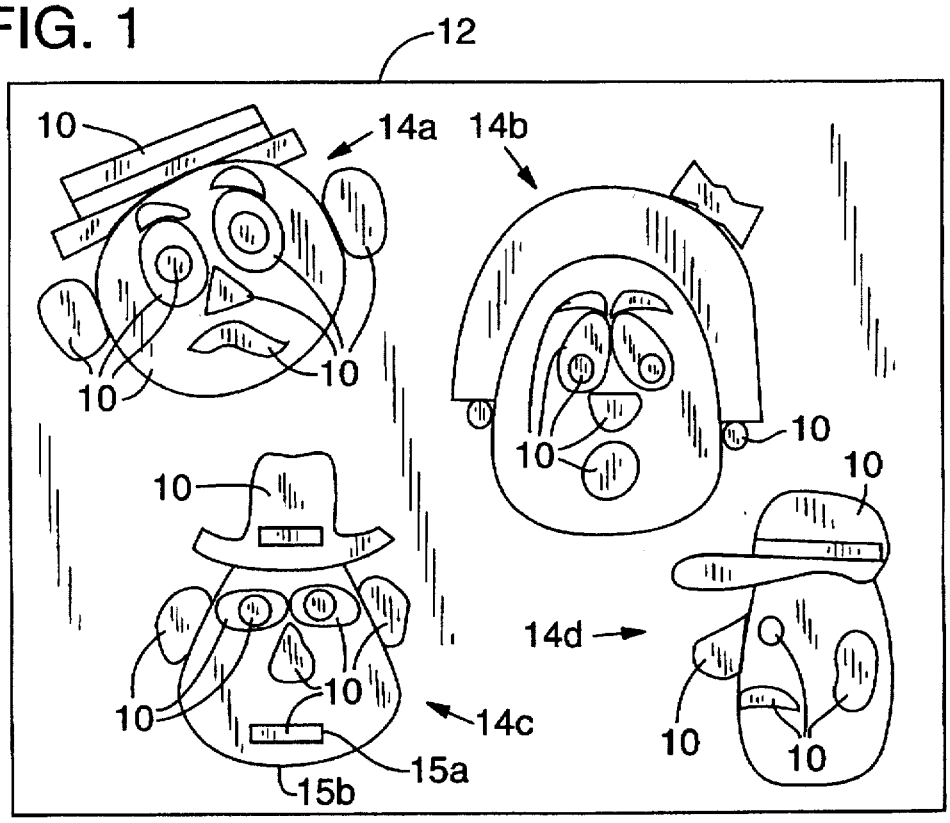
FIGS. 1, 2, 3 and 4 are plan views of magnetizable metallic plates to which are temporarily adhered magnetic parts comprising substantially two-dimensional precut and representational forms made of magnetic material.

Referring to the drawings and particularly to FIG. 1, a plurality of two-dimensional, precut geometric parts or forms 10 cut from flexible magnetic material are temporarily adhered or attached to a magnetizable metallic plate 12. Forms 10 are arranged on plate 12 in a manner to form desired designs 14, such as designs **14*a*,14*b*,14*c*,14*d*, each of which designs comprises a caricature of a face such as a school child would create, or which could be used to amuse pre-school-aged children, or which could be used as an amusement device at social affairs or parties. Forms 10 can be arranged in many configurations. Individual elements 15*a* can be placed on top of other elements 15*b*** to create a particular design, as shown.

Figure 2:
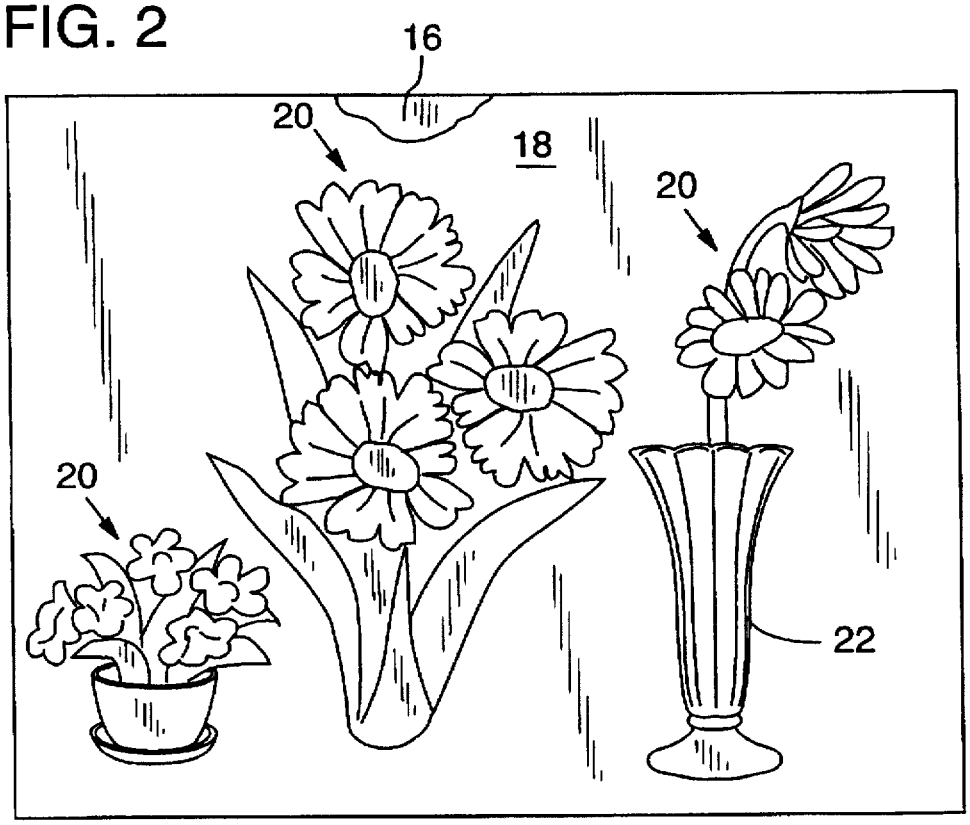

FIG. 2 illustrates a similar plate 16 covered with cloth or plastic 18 and to which two-dimensional, precut representational forms of flowers 20 and a vase 22 are temporarily adhered. With a sufficient variety of such forms, the number of designs that can be created are limited only by the imagination of a user.

Figure 3:
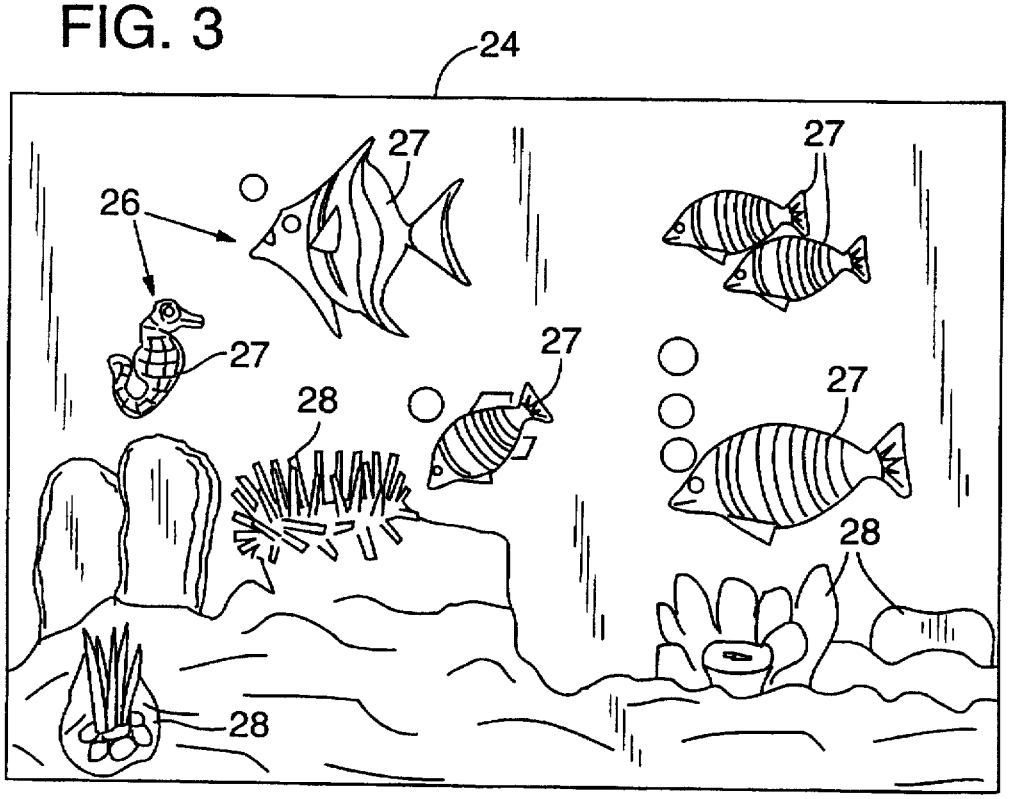

FIG. 3 illustrates a similar plate 24 to which substantially two-dimensional, precut representational forms 26 representing fish 27 and ocean plants 28 are similarly adhered.

Figure 4:
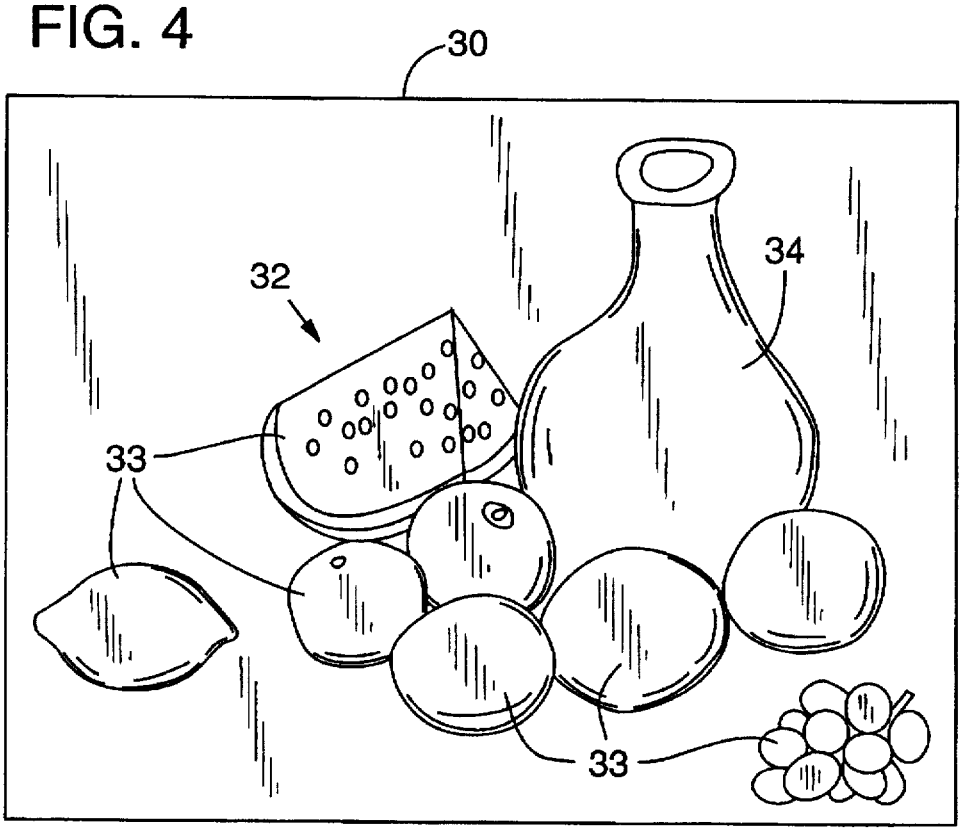

FIG. 4 illustrates a similar plate 30 to which substantially two-dimensional, precut representational forms 32 representing various fruits 33 and a container 34 are similarly temporarily adhered.

Forms such as the forms above noted may desirably be cut from flexible magnetic material. A flexible magnetic material suitable for use with my invention is sold as "Ultra Mag" sheeting by Magnetics, Inc., 11140 Deerfield Road, Cincinnati, Ohio 45242. It is a thermoplastic permanent magnetic blanket type of material having multi-magnetic polarization and is designed to produce great holding power on metal surfaces. "Ultra Mag" sheeting is laminated with a variety of coatings applied with an acrylic adhesive to achieve excellent indoor and outdoor weatherability. Any thickness of flexible magnetic product is suitable for use with my invention, but I have found that "Ultra-Mag Plus" with 0.001 tolerance is preferable. I have also used thicknesses ranging from 15 mil to 60 mil. Of course, sheeting of many different thicknesses can be used.

Figure 5:
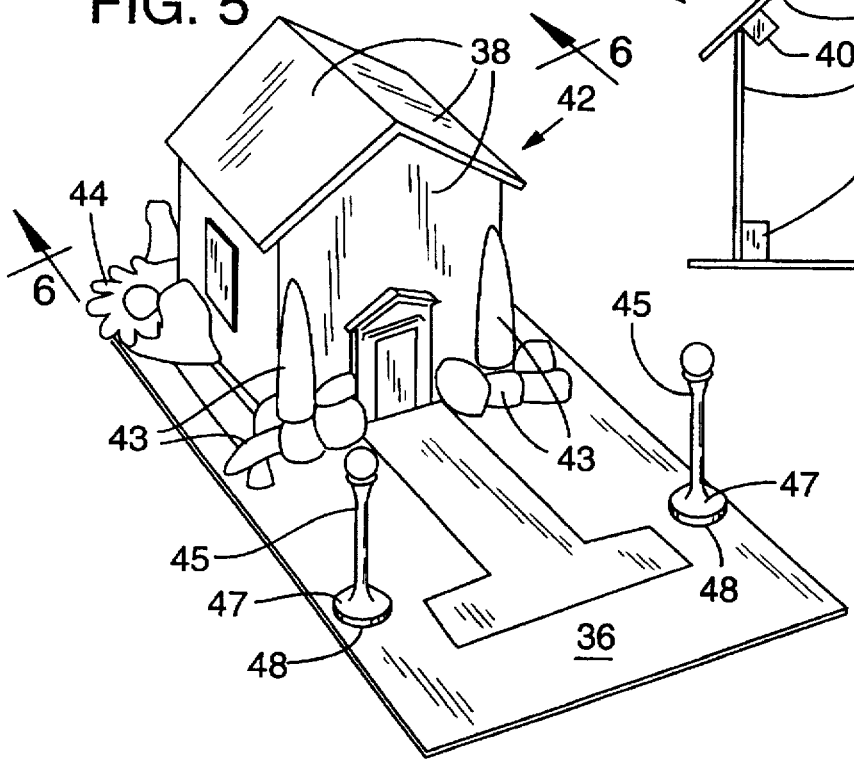
FIG. 5 is a perspective view of a metallic plate to which are attached by a plurality of magnets two-dimensional metallic geometric forms to create a three-dimensional design.
Figure 6:
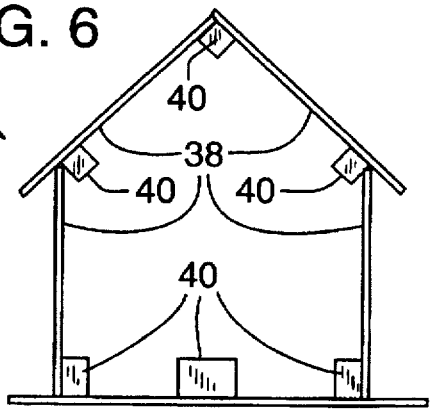
FIG. 6 is a sectional view taken on lines 6—6 of FIG. 5.

Referring now to FIGS. 5 and 6, a metallic plate 36 is illustrated to which are attached two-dimensional, metallic geometric parts or forms 38 using magnets 40. Magnets 40 are chosen to be of a size substantially smaller than the parts 38 themselves. The assembly achieves a representation of a house 42, such as a school child would create. Magnets 40 attach parts 38 to plate 36 and to each other, as shown, to form the three-dimensional house 42. The range of three-dimensional designs that can be created in this is vast, including houses, farms, landscapes, parks, trees, animals, people, etc. The representations of the shrubbery 43, flowers 44 and lighting fixtures 45 are each provided at its base 47 with a small magnet 48 such that the part can adhere to plate 36 to create the desired effect.

My invention further contemplates the use of a magnetic paint that can be applied to a plurality of surfaces, including walls, rocks, structures made of cardboard, plastic, wood, paper, and indeed to any substance having a hard surface, thereby to create a magnetizable surface. The surface must be porous as will be further explained hereinafter.

Figure 7:
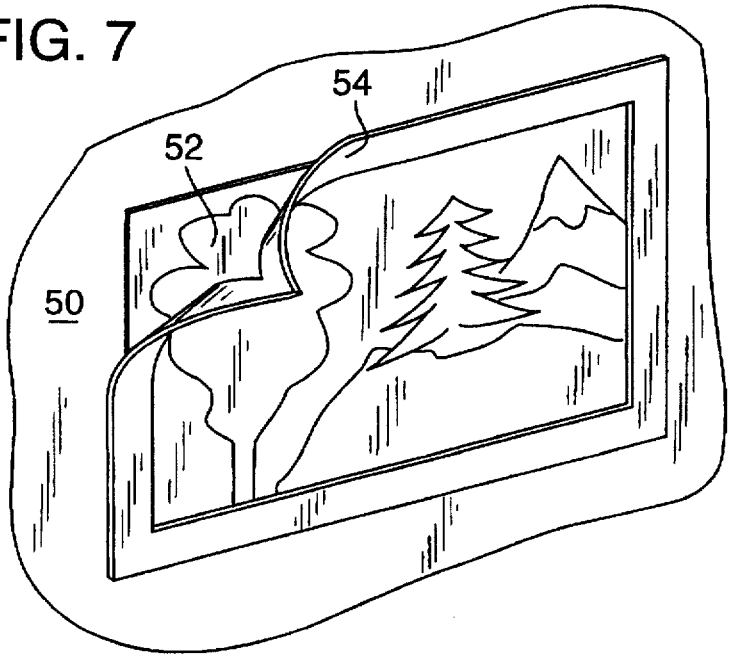
FIG. 7 is an elevational view of a wall painted with magnetic paint to which a picture is removably attached by a frame made of flexible magnetic material.

FIG. 7 illustrates the surface of a wall 50 painted with such a magnetic paint. A picture, which may be a photograph 52, either black-and-white or color, or a xerographic copy of a document, or a diploma or other citation, indeed any substantially two-dimensional item, is illustrated temporarily adhered to wall 50 by a substantially two-dimensional frame 54 cut from flexible magnetic material as above described. The interior dimensions of frame 54 are slightly less than the exterior dimensions of photograph 52, thereby to provide an area of overlap sufficient to retain photograph 52 removably adhered to wall 50. Because photograph 52 is adhered to wall 50 without the necessity of using any tacks, hangers, or the like, damage to the surface of wall 50 is, of course, avoided. Photograph 52 can be removed and replaced with a different photograph merely by lifting frame 54 from contact therewith and replacing photograph 52 with a different one.

A delightful educational use of my invention is in the classroom. There, children can make a variety of two- or three-dimensional designs and then photograph them in color. The teacher can then display the photographs on the classroom wall (painted with magnetic paint as aforesaid) using frames made of flexible magnetic material. Thus, it is possible to have changing displays consistent with the changing seasons the year and with the major holidays, e.g., Christmas, Easter, etc. Using a relatively small number of precut pieces, children can make thousands of different pictures and designs which can then be photographed and displayed. Indeed, the teacher can use the pieces to instruct in the techniques of artistic composition, and this can be another very important educational advantage achievable using the invention.

A magnetic paint suitable for use with this invention has the following ingredients:

| Element | % by wt. |
|---|---|
| Iron oxide | 70 |
| organic adhesive material (bond) | 25 |

-continued

| Element | % by wt. |
|---|---|
| Ceramic powder No. 1 or No. 5 | 4.5 |
| Vegetable oil | 0.5 |

Another formulation suitable for use with this invention has the following ingredients:

| Element | % by Wt. |
|---|---|
| Iron oxide | 70 |
| organic adhesive material (bond) | 25 |
| Plaster powder | 4 |
| Vegetable oil | 1 |

Still another formulation suitable for use with this invention has the following ingredients:

| Element | % by Wt. |
|---|---|
| Strontium ferrite | 10 |
| Iron oxide | 70 |
| Ceramic base material No. 1 or No. 5 | 5 |
| Adhesive bond | 15 |

The above magnetic paints are all isotropic, that is, they have the same magnetic properties in all directions. Any surface so coated can be magnetized along any axis and in any direction. A thin application of the paint will result in a low magnetic holding force; a thicker application will result in a higher magnetic holding force.

Each of the foregoing magnetic paint formulations is a transitional adhesive, that is, it does not adhere on contact, but to the contrary, the paints adheres to the surface to which it is applied by virtue of the solvent contained therein which evaporates through the requisite porous substrate. Thus, the surface to which the magnetic paint is applied must be sufficiently porous such that the solvent in the paint can evaporate therethrough.

The surface may comprise a wall, as illustrated in FIG. 7, or it may comprise a rock or a stone. Other surfaces can be similarly treated, be they cardboard, plastic, wood, paper, or any other relatively firm material, provided only that the surface be sufficiently porous to permit the solvent in the magnetic paint to evaporate through the porous substrate.

Figure 8:
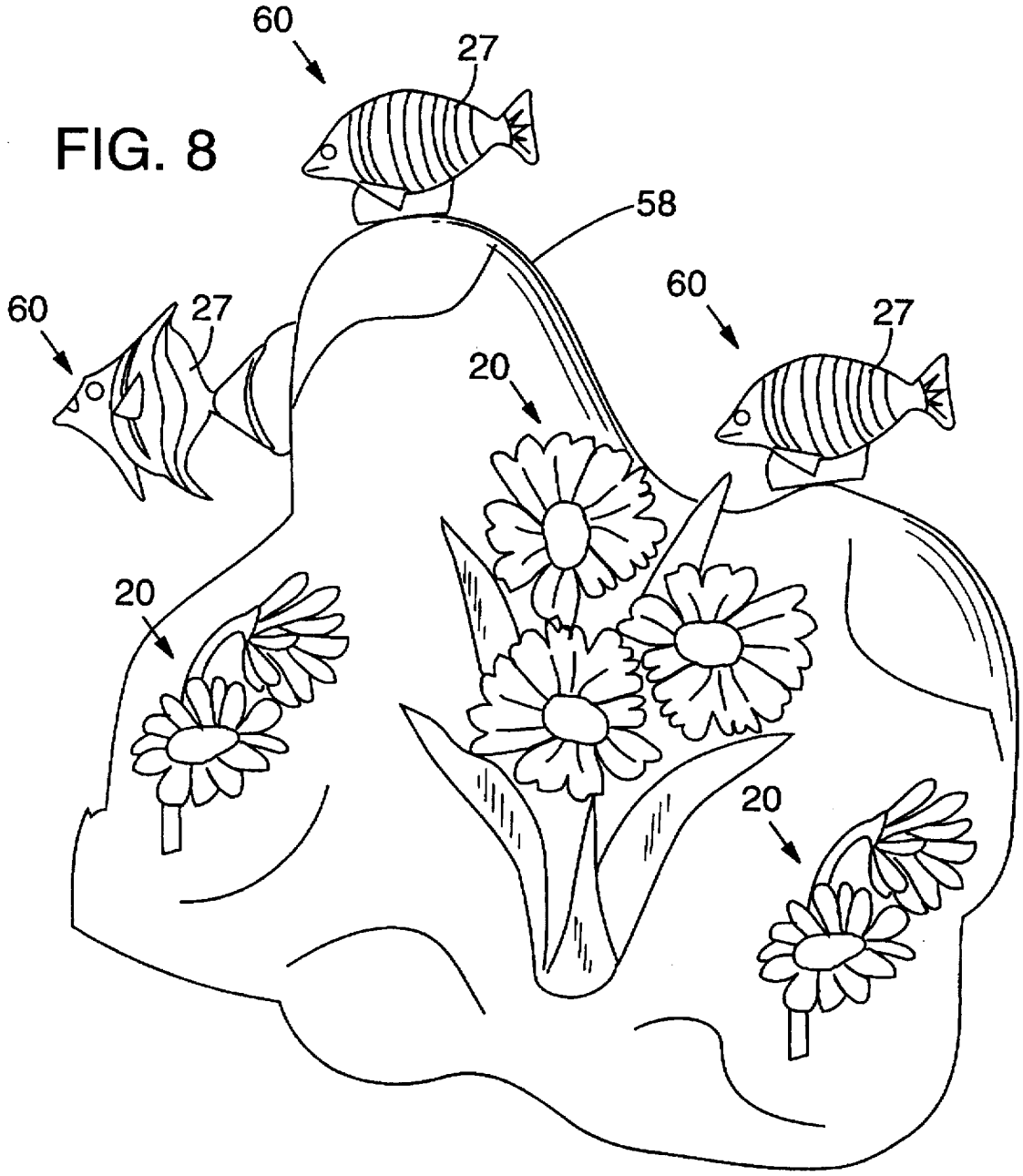
FIG. 8 is a perspective view of a stone painted with a magnetic paint and to which items comprising magnets are temporarily adhered.

FIG. 8 illustrates a stone 58 coated with a magnetic paint having a formulation as above set forth and to which three-dimensional toys, trinkets, or other items 60 may be temporarily adhered. The only requirement is that items 60 be attached themselves to a permanent magnet that will adhere to stone 58, thereby permitting the creation of an individually creative three-dimensional design.

Any non-metallic object or surface—wood, plastic, stone, cardboard, paper, glass—can be painted with the magnetic paint. After drying, the covered surface achieves the properties of a magnetic surface such that a magnet and flexible magnetic material will adhere thereto. The magnetic paint can be used as a primer coat of paint for home or office interior walls. After the primer coat has dried, the wall can be painted with any color, thereby to achieve an instant magnetic bulletin board or a surface that can be used with frames of flexible magnetic material to mount pictures, etc., as aforesaid.

The invention further contemplates the provision of hardenable or malleable magnetic compositions that may be molded into any desired three-dimensional form and to which a magnet or a magnetic part can be removably attached. A magnetic clay or clay-like composition suitable for this use has the following formulation:

| Element | % by Wt. |
|---|---|
| Iron oxide (any color) | 60 |
| organic adhesive material (bond) | 20 |
| Papier mâché | 17 |
| Plastic powder | 2 |
| oil | 1 |

The above composition hardens to a magnetic substance to which magnets or flexible magnetic material may be adhered.

The invention also contemplates provision of a magnetic dough that retains its flexibility and malleability, but which also may be molded into a desired three-dimensional form to which magnets or flexible magnetic material may be adhered. A magnetic dough or dough-like composition suitable for this use has the following formulation:

| Element | % by Wt. |
|---|---|
| Iron oxide | 60 |
| Flour | 15 |
| Corn starch | 10 |
| Vegetable oil | 10 |
| Water | 3 |
| Alum | 1 |
| Non-toxic scent and color | 1 |

The above composition remains flexible and malleable for reasonable lengths of time, although to remain so for extended periods requires storage in a plastic bag. Magnets and flexible magnetic material will adhere to a three-dimensional object molded from the composition.

While the invention has been described in detail and with reference to specific embodiments, it will be apparent to those skilled in the art that changes and modifications can be made therein without departing from the spirit and scope thereof.

I claim:

1. A method of displaying two-dimensional and three-dimensional designs made from magnetic materials, comprising:

providing a magnetic surface;

selecting a plurality of magnetic parts from the group consisting of substantially two-dimensional precut geometric forms, substantially two-dimensional precut representational forms, and three-dimensional representational forms;

attaching the parts to the surface to create an individually expressive design;

taking a photograph of the design;

painting the surface of a wall with a magnetic paint;

providing a substantially two-dimensional frame of flexible magnetic material having interior dimensions less than the exterior dimensions of the photograph; and temporarily attaching the photograph to the wall by placing the frame over the photograph and temporarily adhering the frame to the wall, whereby the photograph is removably attached to the wall without the possibility of damaging the same.

2. The method of claim 1, wherein the photograph comprises a color photograph.

3. The method of claim 1, wherein the magnetic surface comprises a metallic sheet.

4. The method of claim 1, wherein the magnetic surface comprises the surface of a three-dimensional object.

5. The method of claim 1, wherein the magnetic surface comprises a three-dimensional object painted with a magnetic paint.

6. The method of claim 5, wherein the three-dimensional object comprises a moldable hardenable composition.

7. The method of claim 5, wherein the three-dimensional object comprises a flexible malleable composition.

* * * * *